US009450334B2

(12) United States Patent
Haas et al.

(10) Patent No.: US 9,450,334 B2
(45) Date of Patent: Sep. 20, 2016

(54) ELECTRICAL PLUG-IN CONNECTION HAVING A PLUG PART WITH CONTACT PINS FOR PLUGGING INTO SOCKET CONTACTS OF A SOCKET PART

(71) Applicant: WIELAND ELECTRIC GMBH, Bamberg (DE)

(72) Inventors: Edwin Haas, Hausen (DE); Frank Schwabbauer, Neuenmarkt (DE); Juergen Winkler, Hallstadt (DE); Wolfram Hohmann, Bamberg (DE)

(73) Assignee: Wieland Electric GmbH, Bamberg (DE)

( * ) Notice: Subject to any disclaimer, the term of this patent is extended or adjusted under 35 U.S.C. 154(b) by 20 days.

(21) Appl. No.: 14/561,327

(22) Filed: Dec. 5, 2014

(65) Prior Publication Data

US 2015/0180167 A1 Jun. 25, 2015

(30) Foreign Application Priority Data

Dec. 5, 2013 (DE) ..... 10 2013 018 160

(51) Int. Cl.
*H01R 13/213* (2006.01)
*H01R 13/625* (2006.01)
*H01R 13/64* (2006.01)

(52) U.S. Cl.
CPC ..... *H01R 13/625* (2013.01); *H01R 13/64* (2013.01)

(58) Field of Classification Search
CPC ..... H01R 13/625
USPC ..... 439/314, 315, 318, 319, 321
See application file for complete search history.

(56) References Cited

U.S. PATENT DOCUMENTS 3,901,574 A * 8/1975 Paullus ..... H01R 13/623 285/401
3,953,099 A * 4/1976 Wilson ..... H01R 13/50 439/205
3,986,765 A 10/1976 Shaffer et al.
4,531,802 A * 7/1985 Tomsa ..... H01R 13/625 439/314
4,737,119 A * 4/1988 Stieler ..... H01R 13/625 439/318
5,167,522 A * 12/1992 Behning ..... H01R 13/62 439/315

(Continued)

FOREIGN PATENT DOCUMENTS

DE 2604896 A1 8/1976
DE 19541805 A1 5/1996

(Continued)

*Primary Examiner* — Neil Abrams
(74) *Attorney, Agent, or Firm* — Laurence A. Greenberg; Werner H. Stemer; Ralph E. Locher

(57) ABSTRACT

An electrical plug-in connection has a plug part with contact pins and a socket part with socket contacts. Coding elements interact in accordance with the lock/key principle in order for the two parts to be fixed in place in a pre-defined relative plug-in position. One or more protrusions, and apertures complementing the protrusions, are provided on the plug or socket parts. On being connected, one protrusion each is incorporated in an aperture, engaging behind the periphery of the associated aperture in the process. The aperture has two adjacent accommodating chambers. A plug-in accommodating-chamber periphery that is directed away from the plug-in direction, is at such a low level that the associated protrusion slides over it in the plug-in direction, and an arresting accommodating-chamber periphery is at such a high level to effectively prevent sliding of the protrusion over the arresting accommodating-chamber periphery.

13 Claims, 3 Drawing Sheets

(56) References Cited

U.S. PATENT DOCUMENTS 5,627,448 A * 5/1997 Okada ..... B60L 3/12 320/109
5,662,488 A * 9/1997 Alden ..... H01R 13/625 439/314
5,697,814 A 12/1997 Delaunay
6,162,082 A * 12/2000 Karsten ..... H01R 13/625 439/318
6,394,856 B1 * 5/2002 Wertz ..... H01R 13/645 439/681
7,264,517 B1 * 9/2007 Piromalli ..... H01R 13/6456 439/314
7,553,177 B2 * 6/2009 Antonini ..... H01R 13/641 439/314
2009/0269960 A1 10/2009 Holland
2013/0102178 A1 4/2013 Van Swearingen et al.

FOREIGN PATENT DOCUMENTS

EP 2190071 A1 5/2010
GB 186630 A 9/1923

* cited by examiner

ELECTRICAL PLUG-IN CONNECTION HAVING A PLUG PART WITH CONTACT PINS FOR PLUGGING INTO SOCKET CONTACTS OF A SOCKET PART

CROSS-REFERENCE TO RELATED APPLICATION

This application claims the priority, under 35 U.S.C. § 119, of German patent application DE 10 2013 018 160.7, filed Dec. 5, 2013; the prior application is herewith incorporated by reference in its entirety.

BACKGROUND OF THE INVENTION

1. Field of the Invention

The present invention relates to an electrical plug-in connection with a plug part, which accommodates one or more contact pins, and a socket part, which accommodates one or more socket contacts. When the plug-in connection is closed, the contact pins are plugged into the socket contacts. Such a plug-in connection is known, for example, from European patent EP 2 190 071.

In the case of such plug-in connections, reliable contact is ensured only when the contact pins and the contact sockets reliably interengage in a pre-defined manner. For this purpose, it is necessary for the plug part and the socket part, prior to the plug-in connection being closed, to be plugged together from a pre-defined position of the plug part and of the socket part in relation to one another. It is also necessary, in respect of the plug-in connection, for the plug part and the socket part to be locked mechanically to one another in order to prevent the situation where the contact pins slide in an undesired manner out of the contact sockets or socket contacts.

SUMMARY OF THE INVENTION

It is accordingly an object of the invention to provide an electrical plug connector which overcomes the above-mentioned and other disadvantages of the heretofore-known devices and methods of this general type and which provides for an electrical plug-in connection which ensures both reliable closure of the plug-in connection comprising the plug part and socket part and reliable locking of the closed plug-in connection.

With the foregoing and other objects in view there is provided, in accordance with the invention, an electrical plug-in connection, comprising:

a plug part accommodating one or more contact pins;

a socket part accommodating one or more socket contacts, wherein said contact pins are plugged into said socket contacts when the plug-in connection is closed;

coding elements on said plug part and on said socket part and configured to interact in accordance with a lock/key principle in order for said plug and socket parts to be fixed in place in a pre-defined plug-in position in relation to one another;

one or more protrusions and complementary apertures on said plug and socket parts, respectively, such that in each case one protrusion is disposed in a respective said aperture, engaging behind a periphery of the associated aperture in the process, and that said aperture has two accommodating chambers arranged one beside the other;

wherein a periphery of the one plug-in accommodating chamber, said periphery being directed away from a plug-in direction, is at such a low level that an associated said protrusion slides over said periphery in the plug-in direction; and wherein a periphery of the arresting accommodating chamber disposed adjacent said plug-in accommodating chamber, is at such a high level to effectively prevent a sliding of said protrusion over said periphery of said arresting accommodating chamber.

The invention combines, on the one hand, a coding which is located on the plug part and on the socket part, and acts in accordance with the lock/key principle, and, on the other hand, mechanical plug-in-connector locking. For the coding, two complementary coding elements are provided on the plug part and on the socket part, said coding elements interengaging in accordance with the lock/key principle and aligning the plug part and the socket part in a pre-defined plug-in position in relation to one another.

The locking means has one or more protrusions on the plug part or socket part and complementary apertures on the appropriate complementary socket part or plug part. The protrusions here engage behind peripheries of the apertures. The apertures are divided in two such that two accommodating chambers, that is to say a plug-in accommodating chamber and an arresting accommodating chamber, are arranged one beside the other. The plug-in accommodating-chamber periphery here is at such a low level that the associated protrusion can slide or snap-fit over it in the plug-in direction. The arresting accommodating-chamber periphery, in contrast, is configured such that the situation where the protrusion snap-fits or slides over it is effectively prevented. For locking the plug-in connection, therefore in the first instance the plug part and socket part are plugged to one another such that the protrusions slide over the plug-in accommodating-chamber periphery, in order then to be transferred from the plug-in accommodating chamber into the arresting accommodating chamber. In the arresting accommodating chamber, it is then no longer possible for the protrusion to be released from the arresting accommodating chamber over the arresting accommodating-chamber periphery.

In a preferred configuration, the protrusions, rather than being arranged directly on the housing of the plug part or socket part, are a constituent part of a rotary ring arranged in a rotatable manner on the plug part or socket part. The protrusions are preferably arranged equidistantly at identical intervals from one another on the rotary ring. Arranging three protrusions on the inside of the inner lateral surface of the rotary ring has proven to be particularly advantageous.

In a further advantageous configuration, the plug-in accommodating chamber and the arresting accommodating chamber have provided between them a chamber partition wall over which the respective protrusion can slide only in the direction from the plug-in accommodating chamber to the arresting accommodating chamber. This configuration makes it possible for the plug-in connection to be locked straight-forwardly. Unlocking of the plug-in connection is then possible, however, only with the aid of a tool. This effectively prevents undesired unlocking of the plug-in connection. In order to facilitate the locking of the plug-in connection, an introduction slope is provided in the region of the plug-in accommodating chamber.

In a preferred configuration of the invention, it is thus possible for the protrusions to be introduced straightforwardly via the introduction slope into the plug-in accommodating chamber and then into the arresting accommodating chamber. As soon as the locking protrusions have reached their end position in the arresting accommodating chamber, a tool has to be used in order to displace the locking protrusions out of the arresting accommodating chamber again so as to release the plug-in connection again.

Other features which are considered as characteristic for the invention are set forth in the appended claims.

Although the invention is illustrated and described herein as embodied in an electrical plug-in connection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
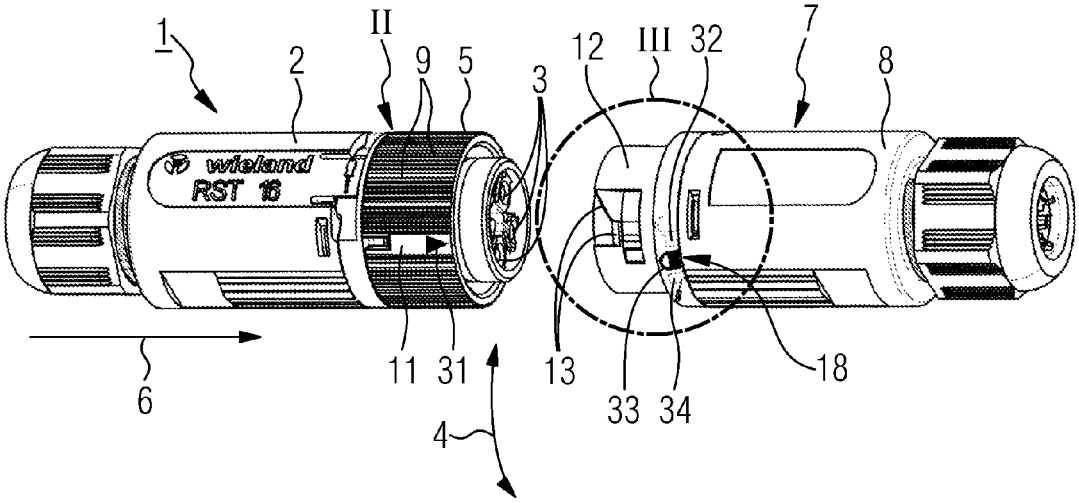
FIG. 1 shows a side view of a plug part and of a socket part in the non-plugged-in state.

Referring now to the figures of the drawing in detail and first, particularly, to FIG. 1 thereof, there is shown a plug part 1 which comprises a plug housing 2 and contact pins 3 in the plug housing 2. A rotary ring 5 is also rotatably mounted on the plug housing 2, such that it can be rotated in a direction of rotation 4.

The plug part 1 is plugged onto a socket part 7, in a plug-in direction 6, into a definitively installed position. On its end side which is directed towards the plug part 1 the socket part 7 has socket contacts, which are not visible in the drawings. The contact pins 3 can be plugged, in the plug-in direction 6, into said socket contacts, which are configured in the form of plug-in sockets. The socket part 7, for its part, has a socket housing 8.

Figure 2:
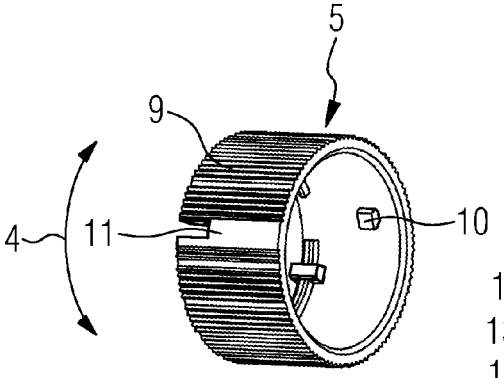
FIG. 2 shows detail II from FIG. 1 on a slightly larger scale, the rotary ring bearing at least one protrusion.

The rotary ring 5 has a ribbing 9 on its outer lateral surface and, on its inside, bears, in the exemplary embodiment, three protrusions 10 distributed equidistantly over the inner lateral surface of the rotary ring 5. Only a single protrusion 10 is visible in the illustration of FIG. 2. Moreover, on its outer lateral surface, the rotary ring 5 bears an indicator groove 11, which is left free by the ribbing 9.

Figure 3:
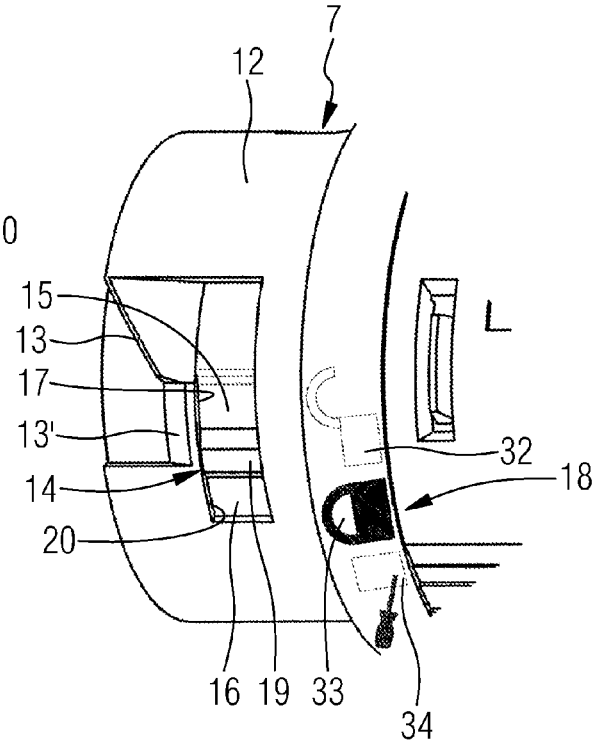
FIG. 3 shows detail III from FIG. 1 on a slightly larger scale, an aperture with two accommodating chambers arranged one beside the other.

FIG. 3 shows, in the first instance, an installation collar 12, which is arranged at that end of the socket part 7 which is directed towards the plug part 1 in the definitively installed state. The installation collar 12 has a hollow-cylindrical configuration and has its outer lateral surface butting against the inner lateral surface of the rotary ring 5 in the definitively installed state. The inside of the installation collar 12 can be fitted over that region of the plug part 1 which encompasses the contact pins 3.

FIG. 3 also shows an introduction slope for mechanically introducing the protrusion 10 into the two-part aperture 14 on the installation collar 12 of the socket part 7. The introduction slope is in two parts. First of all, the introduction slope has a radial introduction-slope region 13. The radial introduction-slope region 13 is followed by the axial introduction-slope region 13'. If one of the protrusions 10 comes into contact with the radial introduction-slope region 13 of the introduction slope, it is guided, by continued rotation of the rotary ring 5 in the direction of rotation 4, into the axial introduction-slope region 13'. The aperture 14 comprises, in the first instance, the plug-in accommodating chamber 15 and the arresting accommodating chamber 16, which is arranged alongside the plug-in accommodating chamber 15 as seen in the direction of rotation 4 of the rotary ring 5. The axial introduction-slope region 13' here is arranged in front of the plug-in accommodating chamber 15, more precisely the plug-in accommodating-chamber periphery 17. If the protrusion 10 is pushed over the axial introduction-slope region 13 when the plug part 1 and the socket part 7 are joined together in the plug-in direction 6, the protrusion 10 breaches the plug-in accommodating-chamber periphery 17 and thus latches into the plug-in accommodating chamber 15.

Figure 6:
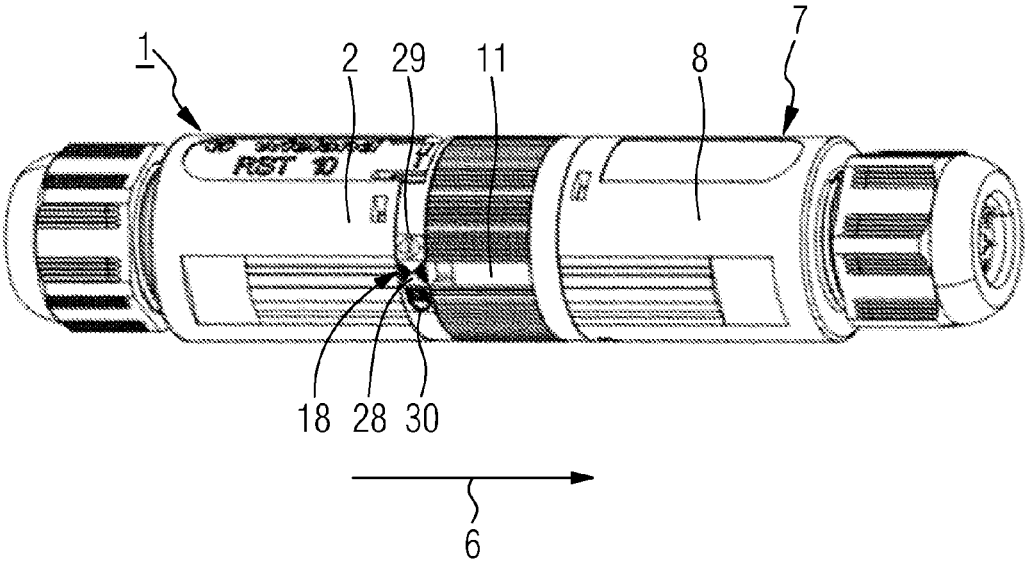
FIG. 6 shows the closed plug-in connection with plugged-together plug part and socket part in a closed position which can be released without using a tool.

The introduction slope, which comprises the radial introduction-slope region 13 and the axial introduction-slope region 13' thus forms a mechanical guide for the protrusion 10. When the plug part 1 and the socket part 7 are joined together or plugged together, the protrusion 10 is guided positively by the introduction slope such that the protrusion 10 slides over the plug-in accommodating-chamber periphery 17 and, as it were, falls into the plug-in accommodating chamber 15. In this position, the protrusion 10 can simply be pulled over the plug-in accommodating-chamber periphery 17 again, counter to the plug-in direction 6. This corresponds to that closed position of the plug part 1 and socket part 7 which is illustrated in FIG. 6, no tool being required for releasing the two parts from one another. The indicator groove 11 here runs in linear alignment, as seen in the plug-in direction 6, with the central section 28 of the three-part indicator 18. This central section 28 of the three-part indicator 18 denotes the closed plug-in connection which can be released without using a tool. The initial state of the plug part 1, prior to installation, the indicator groove 11 runs in linear alignment with the upper outer section 29 of the indicator 18 which indicates the open state of the rotary ring 5.

Figure 7:
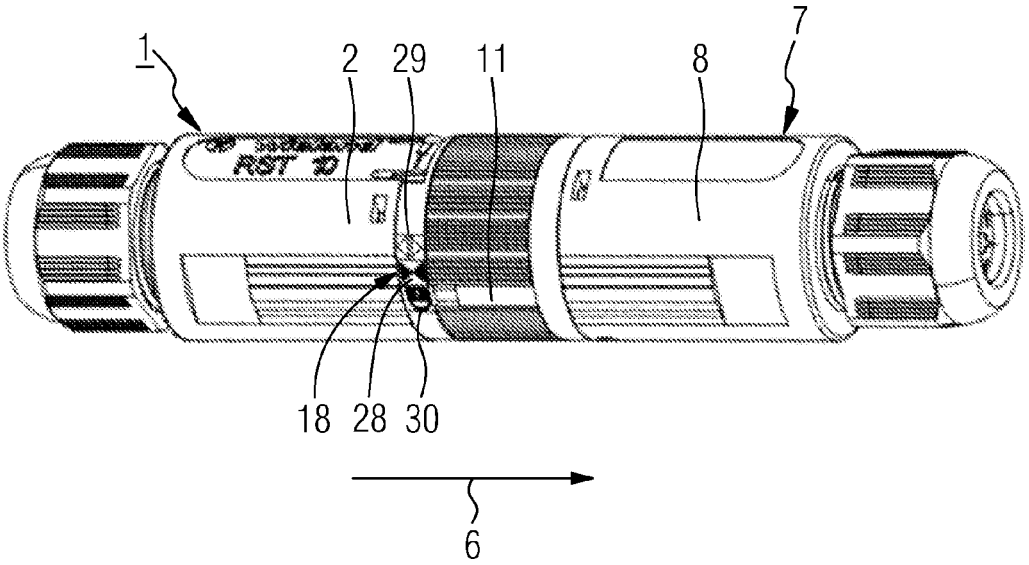
FIG. 7 shows the closed plug-in connection with plugged-together plug part and socket part in a closed position which can be released exclusively using a tool.

For definitive closure of the plug-in connection, the rotary ring 5 is rotated again in the direction of rotation 4, in the downward direction in the exemplary embodiments illustrated. The protrusion 10 here slides over the intermediate chamber wall 19, which is arranged between the plug-in accommodating chamber 15 and the arresting accommodating chamber 16. As soon as the protrusion 10 has slid over the intermediate chamber wall 19, the protrusion 10 is incorporated firmly in the arresting accommodating chamber 16. Both the intermediate chamber wall 19 and the arresting accommodating-chamber periphery 20 are at such a high level here that the protrusion 10 cannot be pulled manually over the intermediate chamber wall 19 or the arresting accommodating-chamber periphery 20. Rather, a tool, for example a screwdriver blade, is required in order to release the connection again. Accordingly, in this closed position of the device, the indictor groove 11 runs in linear alignment with the opposite lower outer section 30 of the three-part indicator 18, said outer section being directed away from the upper outer indicator section 29 in FIGS. 6 and 7, and thus signals to the user that the plug-in connection has been closed in a manner in which it can be released only using a tool (cf. FIG. 7).

FIGS. 1 and 3 show an alternative configuration of the indicator 18. To render the indicator clearly visible, the indicator groove 11 bears an indicator arrow 31. In the definitively installed state, this indicator arrow 31 points to the indicator 18 on the socket part 7. The indicator 18, for its part, has pictograms, that is to say illustrations of an open lock 32, of a closed lock 33 and of a screwdriver 34. As seen in comparison with the indicator 18 shown in FIGS. 6 and 7, the open lock 32 corresponds to the upper outer section 29, the closed lock 33 corresponds to the central section 28 and the screwdriver 34, finally, corresponds to the lower outer indicator section 30. When the plug part 1 and the socket part 7 are joined together, the indicator arrow 31 points, in the first instance, to the open lock 32. In this functional position, the protrusion 10 runs onto the radial introduction-slope region 13. As soon as the protrusion 10 leaves the radial introduction-slope region 13 and travels the axial introduction-slope region 13', in order to slide into the plug-in accommodating chamber 15, the indicator arrow 31 points to the closed lock 33. If the device is fully locked by virtue of the protrusion 10 being shifted into the arresting accommodating chamber 16, the indicator arrow 31 points to the symbol of the indicator 18 with the screwdriver 34. This signals that the plug-in connection can be released again from this functional position only with the aid of a tool.

Figure 4:
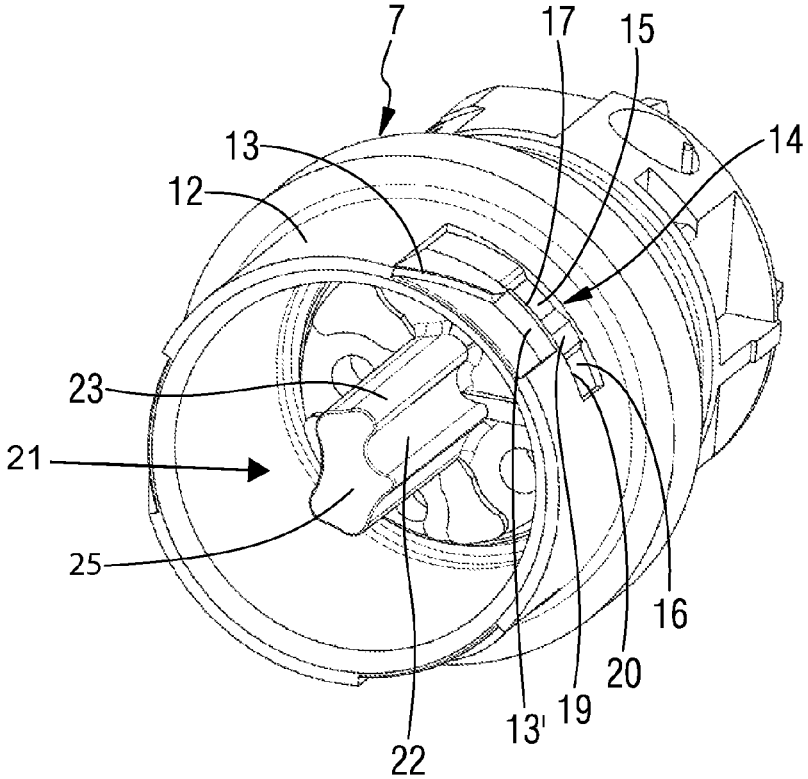
FIG. 4 shows a perspective view of a socket part with a coding pin as coding element arranged in the socket part.

The perspective view of the socket part 7 in FIG. 4, finally, shows a coding element 21'. The coding element 21' is configured essentially in the form of an axial coding pin 21 extending in the socket part in the plug-in direction 6 and a complementary socket 24 in the plug part. This coding pin 21 is of irregular shape in cross section. This cross-sectional shape is made up essentially of curved grooves 22 and of crosspieces 23 which adjoin the curved grooves 22. The cross-sectional shape of the coding pin 21 thus comprises convex and concave structures which essentially follow one after the other in a row to form a key shape which is, as far as possible, unique.

Figure 5:
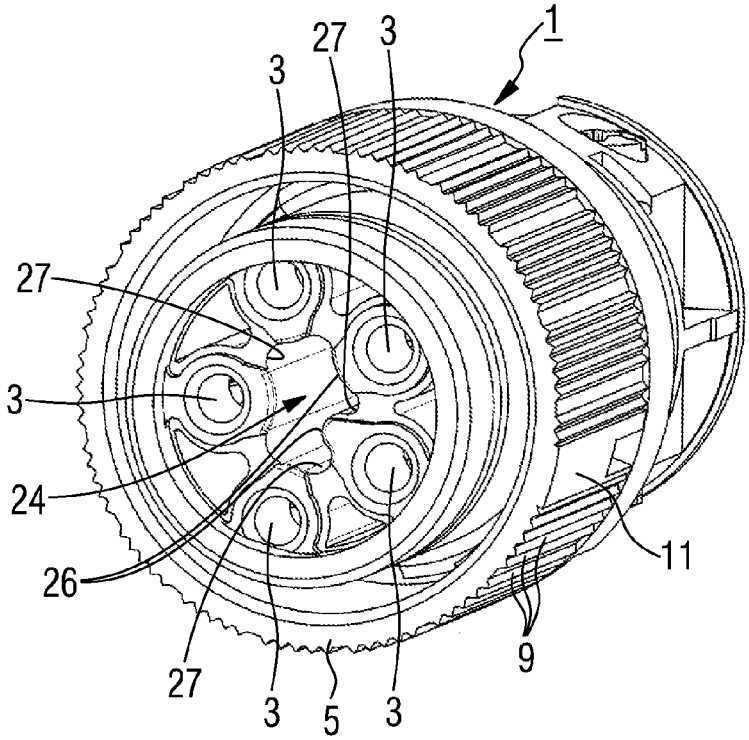
FIG. 5 shows a perspective view of a plug part designed to complement the socket part and having an accommodating socket as coding element arranged in the socket part.

FIG. 5 shows the correspondingly complementary coding element on the plug part 1. Here, the coding element is configured in the form of an accommodating socket 24 and, when the plug part 1 and socket part 7 have been plugged together, fully accommodates the coding pin 21 within it. The contact pins 3 of the plug contacts are arranged around the accommodating socket 24 on an imaginary circular line. These contact pins engage in the socket contacts 25 on the socket part 7 in the definitively installed position.

The hollow cross section of the accommodating sleeve or accommodating socket 24 is designed to complement the volume cross section of the coding element 21' configured in the form of a coding pin 21 on the socket part 7. In other words, the accommodating socket 24 has convex regions designed in the form of springs 26 wherever the coding pin 21 has concave regions designed in the form of grooves 22. Conversely, concave regions 27 on the accommodating sleeve or accommodating socket 24 correspond to the convex regions on the coding pin 21. The rod-like or pin-like coding pin 21 and the accommodating socket 24 thus interact in accordance with the lock/key principle, wherein the accommodating socket 24 corresponds to the lock and the coding pin 21 corresponds to the key.

This always ensures that, when the electrical plug-in connection is plugged together, the plug part 1 and the socket part 7 are arranged in the appropriate pre-defined position in relation to one another and, during the plugging-in operation, it is also the case that the corresponding individual parts both in the case of the contacts and in the case of the other elements described above come into contact with one another in an accurately fitting manner. In particular, the protrusion 7 comes into contact with the radial introduction-slope region 13, and/or the axial introduction-slope region 13', in an accurately fitting manner in order to be transferred reliably into the plug-in accommodating chamber 15 and then the arresting accommodating chamber 16.

Once more, in summary: There is provided an electrical plug-in connection comprising a plug part 1, which accommodates one or more contact pins 3, and a socket part 7, which accommodates one or more socket contacts, such that, when the plug-in connection is closed, the contact pins 3 are plugged into the socket contacts, characterized by coding elements 21, 24, 25 which are located on the plug part 1 and on the socket part 7 and interact in accordance with the lock/key principle in order for the two parts to be fixed in place in a pre-defined plug-in position in relation to one another, and by one or more protrusions 10, and apertures 14 complementing the protrusions 10, on the plug parts 1 or socket parts 7 such that in each case one protrusion 10 is incorporated in the aperture 14, engaging behind the periphery of the associated aperture 14 in the process, and that the aperture 14 has two accommodating chambers 15, 16 arranged one beside the other, wherein the plug-in accommodating-chamber periphery 17 of the one plug-in accommodating chamber 15, said periphery being directed away from the plug-in direction 6, is at such a low level that the associated protrusion 10 slides over it in the plug-in direction 6, and wherein the arresting accommodating-chamber periphery 20 of the arresting accommodating chamber 16, which is adjacent to the plug-in accommodating chamber 15, is at such a high level that the situation where the protrusion 10 slides over said arresting accommodating-chamber periphery 20 is effectively prevented.

The following is a summary list of reference numerals and the corresponding structure used in the above description of the invention:

1 Plug part
2 Plug housing
3 Contact pin
4 Direction of rotation
5 Rotary ring
6 Plug-in direction
7 Socket part
8 Socket housing
9 Ribbing
10 Protrusion
11 Indicator groove
12 Installation collar
13 Radial introduction-slope region
13' Axial introduction-slope region
14 Aperture
15 Plug-in accommodating chamber
16 Arresting accommodating chamber
17 Plug-in accommodating-chamber periphery
18 Indicator
19 Intermediate chamber wall

20 Arresting accommodating-chamber periphery
21 Coding pin of coding element
21' Coding element
22 Groove
23 Crosspiece
24 Accommodating socket
25 Contact socket
26 Spring
27 Concave region
28 Central section
29 Upper outer section
30 Lower outer indicator section
31 Indicator arrow
32 Open lock
33 Closed lock
34 Screwdriver

The invention claimed is:

1. An electrical plug-in connection, comprising:

a plug part accommodating one or more contact pins;

a socket part accommodating one or more socket contacts, wherein said contact pins are plugged into said socket contacts when the plug-in connection is closed;

coding elements on said plug part and on said socket part and configured to interact in accordance with a lock/key principle in order for said plug and socket parts to be fixed in place in a pre-defined plug-in position in relation to one another;

one or more protrusions and complementary apertures on said plug and socket parts, respectively, such that in each case one protrusion is disposed in a respective said aperture, engaging behind a periphery of the associated aperture in the process, and that said aperture has two accommodating chambers arranged one beside the other;

wherein a periphery of the one plug-in accommodating chamber, said periphery being directed away from a plug-in direction, is at such a low level that an associated said protrusion slides over said periphery in the plug-in direction; and wherein a periphery of the arresting accommodating chamber disposed adjacent said plug-in accommodating chamber, is at such a high level to effectively prevent a sliding of said protrusion over said periphery of said arresting accommodating chamber.

2. The plug-in connection according to claim 1, which comprises a rotary ring having an inner lateral surface, and wherein said one or more protrusions is or are arranged on said inner lateral surface of said rotary ring arranged on said plug part or said socket part.

3. The plug-in connection according to claim 2, wherein a plurality of said protrusions are arranged at identical intervals from one another on said inner lateral surface of said rotary ring.

4. The plug-in connection according to claim 2, wherein three said protrusions are arranged on said inner lateral surface of said rotary ring.

5. The plug-in connection according to claim 1, which comprises an intermediate chamber wall over which the respective said protrusion can slide only in a direction from said plug-in accommodating chamber to said arresting accommodating chamber.

6. The plug-in connection according to claim 1, wherein an introduction slope is formed in front of said plug-in accommodating chamber.

7. The plug-in connection according to claim 2, wherein said rotary ring is formed with an indicator groove on an outer lateral surface thereof, and said indicator groove is disposed to interact with an indicator having a plurality of indicator sections.

8. The plug-in connection according to claim 7, wherein the indicator has three indicator sections.

9. The plug-in connection according to claim 8, wherein said three indicator sections have pictograms printed thereon.

10. The plug-in connection according to claim 1, wherein said coding elements include a coding element being a coding pin on said socket part or said plug part and a coding element being a complementary accommodating socket on said plug part or said socket part.

11. The plug-in connection according to claim 10, wherein said coding elements have an irregular cross-sectional shape.

12. The plug-in connection according to claim 11, wherein the cross-sectional shape of said coding elements comprises convex and concave structures which follow one after the other irregularly in series to form a substantially unique key shape.

13. The plug-in connection according to claim 11, wherein the irregular cross-sectional shape of the coding elements is defined by curved grooves and crosspieces adjoining the curved grooves.

* * * * *